US011329369B2

(12) United States Patent
Ryu et al.

(10) Patent No.: US 11,329,369 B2
(45) Date of Patent: May 10, 2022

(54) FILM ANTENNA AND DISPLAY DEVICE INCLUDING THE SAME

(71) Applicant: DONGWOO FINE-CHEM CO., LTD., Jeollabuk-do (KR)

(72) Inventors: Han Sub Ryu, Gyeongsangbuk-do (KR); Jong Min Kim, Gyeonggi-do (KR); Dong Pil Park, Incheon (KR)

(73) Assignee: DONGWOO FINE-CHEM CO., LTD., Jeollabuk-Do (KR)

( * ) Notice: Subject to any disclaimer, the term of this patent is extended or adjusted under 35 U.S.C. 154(b) by 0 days.

(21) Appl. No.: 16/855,166

(22) Filed: Apr. 22, 2020

(65) Prior Publication Data

US 2020/0251814 A1 Aug. 6, 2020

Related U.S. Application Data

(63) Continuation of application No. PCT/KR2018/013074, filed on Oct. 31, 2018.

(30) Foreign Application Priority Data

Oct. 31, 2017 (KR) ..... 10-2017-0143045

(51) Int. Cl.

| | |
|---|---|
| ***H01Q 1/38*** | (2006.01) |
| ***H01Q 1/24*** | (2006.01) |
| ***H01Q 7/00*** | (2006.01) |
| ***H01Q 9/04*** | (2006.01) |

(52) U.S. Cl.

CPC ..... *H01Q 1/38* (2013.01); *H01Q 1/243* (2013.01); *H01Q 7/00* (2013.01); *H01Q 9/0407* (2013.01)

(58) Field of Classification Search

CPC ..... H01Q 1/38; H01Q 1/243; H01Q 7/00; H01Q 9/0407; H01Q 5/35; H01Q 21/28

See application file for complete search history.

(56) References Cited

U.S. PATENT DOCUMENTS

| | | | | |
|---|---|---|---|---|
| 9,859,616 | B2 * | 1/2018 | Ikeda | H04B 5/0031 |
| 10,326,196 | B2 * | 6/2019 | Kim | H01Q 15/006 |
| 2010/0075596 | A1 | 3/2010 | Demarco et al. | |
| 2014/0045424 | A1 * | 2/2014 | Fratti | H01Q 1/44 455/41.1 |

(Continued)

FOREIGN PATENT DOCUMENTS

| | | |
|---|---|---|
| JP | H 1-188003 A | 7/1989 |
| JP | H 3-113901 A | 5/1991 |

(Continued)

OTHER PUBLICATIONS

International Search Report for PCT/KR2018/013074 dated Feb. 7, 2019.

(Continued)

*Primary Examiner* — Seung H Lee

(74) *Attorney, Agent, or Firm* — The PL Law Group, PLLC

(57) ABSTRACT

A film antenna according to an embodiment of the present invention includes a plurality of radiation patterns corresponding to different frequency bands, transmission lines extending from each of the radiation patterns, and a driving circuit unit commonly connected to the transmission lines. Signaling transmission/reception efficiency and reliability may be improved by integrating the radiation patterns of different frequency bands.

14 Claims, 7 Drawing Sheets

(56) References Cited

U.S. PATENT DOCUMENTS

| | | | | |
|---|---|---|---|---|
| 2015/0255856 | A1 | 9/2015 | Hong et al. | |
| 2016/0190678 | A1* | 6/2016 | Hong | H01Q 1/273 343/700 MS |
| 2016/0261026 | A1 | 9/2016 | Han et al. | |
| 2018/0287243 | A1* | 10/2018 | Ko | H01Q 1/38 |
| 2019/0082564 | A1 | 3/2019 | Jang | |

FOREIGN PATENT DOCUMENTS

| | | | |
|---|---|---|---|
| JP | 2000-138512 | A | 5/2000 |
| JP | 2004-112397 | A | 4/2004 |
| JP | 2007-274528 | A | 10/2007 |
| JP | 2010-200207 | A | 9/2010 |
| JP | 2010-283855 | A | 12/2010 |
| JP | 2017-175540 | A | 9/2017 |
| KR | 10-2003-0095557 | A | 12/2003 |
| KR | 10-2014-0101179 | A | 8/2014 |
| KR | 10-2017-0040773 | A | 4/2017 |
| KR | 10-1744886 | B1 | 6/2017 |
| WO | WO 2006/106759 | A1 | 10/2006 |
| WO | WO 2016/163838 | A1 | 10/2016 |
| WO | WO 2017/082652 | A1 | 5/2017 |

OTHER PUBLICATIONS

Office action dated Sep. 21, 2021 from Japan Intellectual Property Office in a counterpart Japanese Patent Application No. 2020-522814 (all the cited references are listed in this IDS.) (English translation is also submitted herewith.).

Office action dated May 11, 2021 from Japan Intellectual Property Office in a counterpart Japanese Patent Application No. 2020-522814 (all the cited references are listed in this IDS.) (English translation is also submitted herewith.).

Notice of Allowance dated Feb. 8, 2022 from Japan Intellectual Property Office in a counterpart Japanese Patent Application No. 2020-522814 (all the cited references are listed in this IDS.) (English translation is also submitted herewith.).

* cited by examiner

FILM ANTENNA AND DISPLAY DEVICE INCLUDING THE SAME

CROSS REFERENCE TO RELATED APPLICATIONS AND CLAIM OF PRIORITY

The present application is a continuation application to International Application No. PCT/KR2018/013074 with an International Filing Date of Oct. 31, 2018, which claims the benefit of Korean Patent Application No. 10-2017-0143045 filed on Oct. 31, 2017 at the Korean Intellectual Property Office, the disclosures of which are incorporated by reference herein in their entirety.

BACKGROUND

1. Field

The present invention relates to a film antenna and a display device including the same. More particularly, the present invention related to a film antenna including an electrode and a dielectric layer and a display device including the same.

2. Description of the Related Art

As information technologies have been developed, a wireless communication technology such as Wi-Fi, Bluetooth, etc., is combined with a display device in, e.g., a smartphone form. In this case, an antenna may be combined with the display device to provide a communication function.

Further, as thin-layered display devices with high transparency and resolution such as a transparent display device, a flexible display device, etc., have been developed recently, development of the antenna having improved signaling sensitivity in a limited thickness is also required.

However, as the display device to which the antenna is employed becomes thinner and lighter, a space for the antenna may also be reduced. Accordingly, a construction of the antenna that may have sensitivity to various types of signal at a broadband range may become difficult.

Additionally, when the antenna is disposed on a front surface of the display device, the antenna having high transparency is desirable so as not to affect image quality.

SUMMARY

According to an aspect of the present invention, there is provided a film antenna having improved radiation and optical properties.

According to an aspect of the present invention, there is provided a display device including a film antenna with improved radiation and optical properties.

The above aspects of the present invention will be achieved by one or more of the following features or constructions:

(1) A film antenna, including: a plurality of radiation patterns corresponding to different frequency bands; transmission lines extending from each of the radiation patterns; and a driving circuit unit connected to the transmission lines.

(2) The film antenna according to the above (1), wherein the plurality of radiation patterns include a first radiation pattern, a second radiation pattern and a third radiation pattern arranged sequentially from the driving circuit unit.

(3) The film antenna according to the above (2), wherein resonance frequencies sequentially decrease in an order of the first radiation pattern, the second radiation pattern and the third radiation pattern.

(4) The film antenna according to the above (2), wherein the first radiation pattern, the second radiation pattern and the third radiation pattern are each independently controlled by the driving circuit unit.

(5) The film antenna according to the above (2), wherein the first radiation pattern, the second radiation pattern and the third radiation pattern each has a loop shape, and the first radiation pattern is disposed in a space within the loop shape of the second radiation pattern, and the second radiation pattern is disposed in a space within the loop shape of the third radiation pattern.

(6) The film antenna according to the above (5), further including a dummy mesh pattern between the plurality of radiation patterns or in a space within the loop shapes of the plurality of radiation patterns.

(7) The film antenna according to claim 6), wherein the dummy mesh pattern includes cut regions.

(8) The film antenna according to the above (1), wherein the plurality of radiation patterns include a mesh pattern structure.

(9) The film antenna according to the above (1), wherein the driving circuit unit includes a plurality of driving circuit units, and the plurality of radiation patterns of different frequency bands are integrated with each of the driving circuit units.

(10) The film antenna according to the above (1), wherein the plurality of radiation patterns are positioned on the same plane.

(11) The film antenna according to claim 10, further including: a dielectric layer on which the plurality of radiation patterns are disposed; and a ground layer disposed under the dielectric layer.

(12) A display device including the film antenna according to embodiments as described above.

(13) The display device according to the above (12), wherein the film antenna is disposed at a front face of the display device.

(14) The display device according to the above (13), wherein the plurality of radiation patterns are disposed on a display region of the display device.

The film antenna according to embodiments of the present invention may include radiation electrodes of different frequency bands which may be sequentially arranged on the same plane. Thus, a broadband antenna having a sensitivity to a plurality of different frequencies may be achieved in a limited space.

The radiation patterns may be connected to one driving circuit unit through transmission lines. Therefore, each radiation pattern of different frequency bands may be controlled collectively, and may be integrated in the film antenna. Further, a desired frequency may be selectively received and transferred using the radiation pattern to improve signal sensitivity and radiation efficiency.

In exemplary embodiments, a dummy pattern having a mesh pattern structure may be formed between the radiation patterns to improve transmittance of the antenna and to prevent electrode visibility.

In exemplary embodiments, the film antenna may be disposed toward a front face of the display device to implement a display device capable of high transmittance and broadband communication.

DETAILED DESCRIPTION OF THE EMBODIMENTS

According to exemplary embodiments of the present invention, there is provided a film antenna including a plurality of radiation patterns of different frequency bands, transmission lines diverging from each of the radiation patterns and a driving circuit unit commonly connected to the transmission lines.

The film antenna may be, e.g., a microstrip patch antenna fabricated as a transparent film. The film antenna may be applied to a communication device for high or ultra-high frequency band (e.g., 3 G, 4 G, 5 G or more) mobile communications. For example, the film antenna may be operable in the ultra-high frequency band of about 1 GHz or more, in an embodiment, from about 20 GHz to about 60 GHz. The film antenna may be also operable in a frequency band of about 1 GHz or less.

According to exemplary embodiments of the present invention, there is provided a display device including the film antenna. The film antenna may be also applied to various devices or objects such as an automobile, a home electronic device, an architecture, etc.

Hereinafter, the present invention will be described in detail with reference to the accompanying drawings. However, those skilled in the art will appreciate that such embodiments described with reference to the accompanying drawings are provided to further understand the spirit of the present invention and do not limit subject matters to be protected as disclosed in the detailed description and appended claims.

Figure 1:
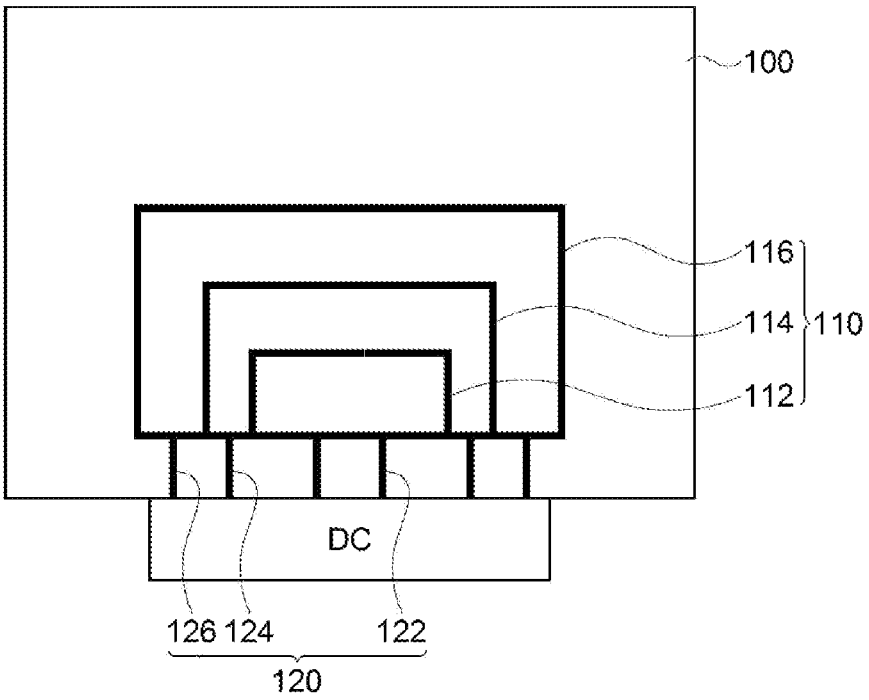
FIGS. 1 and 2 are a schematic top planar view and a schematic cross-sectional view, respectively, illustrating a film antenna in accordance with exemplary embodiments.
Figure 2:
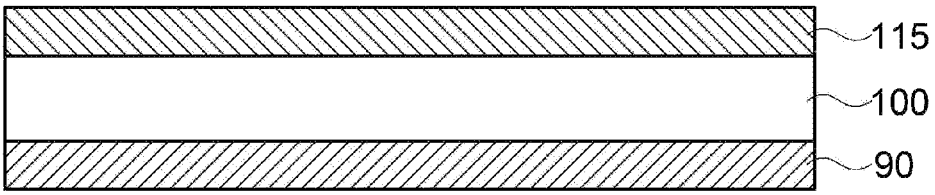

FIGS. 1 and 2 are a schematic top planar view and a schematic cross-sectional view, respectively, illustrating a film antenna in accordance with exemplary embodiments.

Referring to FIGS. 1 and 2, the film antenna may include a dielectric layer 100 and an electrode layer 115 formed on the dielectric layer 100. The electrode layer 115 may include radiation patterns 110 and transmission lines 120.

The dielectric layer 100 may include an insulating material having a predetermined dielectric constant. The dielectric layer 100 may include, e.g., an inorganic insulating material such as glass, silicon oxide, silicon nitride and a metal oxide, or an organic insulating material such as an epoxy resin, an acrylic resin, an imide-based resin, etc.

In some embodiments, the dielectric layer 100 may include an adhesive film including a pressure-sensitive adhesive (PSA) or an optically clear adhesive (OCA).

The dielectric layer 100 may function as a film substrate of a film antenna on which radiation patterns 110 and transmission lines 120 are formed.

In some embodiments, a dielectric constant of the dielectric layer 100 may be adjusted in a range from about 1 to about 20. If the dielectric constant exceeds about 20, a driving frequency may be excessively reduced and an antenna driving in a desired high frequency band, e.g., from 25 GHz to 35 GHz (e.g., a 5 G band) may not be obtained.

In exemplary embodiments, the radiation pattern 110 may include a plurality of radiation patterns having different resonance frequencies. In some embodiments, the radiation patterns 110 may include a first radiation pattern 112, a second radiation pattern 114 and a third radiation pattern 116 having different resonance frequencies from each other.

As illustrated in FIG. 1, the first radiation pattern 112, the second radiation pattern 114, and the third radiation pattern 116 may be sequentially arranged from a side of the dielectric layer 100. In some embodiments, the first radiation pattern 112, the second radiation pattern 114, and the third radiation pattern 116 may have a loop shape. In FIG. 1, a shape of each radiation pattern 110 is illustrated as a rectangle. However, the shape of each radiation pattern 110 may be appropriately modified in consideration of an area, a frequency or the like of the film antenna.

For example, the first radiation pattern 112 may be included in the second radiation pattern 114, and the second radiation pattern 114 may be included in the third radiation pattern 116. Accordingly, the plurality of radiation patterns 110 may be sequentially arranged while widths or lengths thereof are sequentially expanded.

In exemplary embodiments, resonance frequencies capable of transmitting and receiving may be decreased by an order of the first radiation pattern 112, the second radiation pattern 114 and the third radiation pattern 116.

In some embodiments, the first radiation pattern 112 may have a resonance frequency corresponding to a 5 G communication (e.g., from about 28 GHz to about 30 GHz), the second radiation pattern 114 may have a resonance frequency corresponding to a Wi-Fi communication (e.g., from about 2.5 GHz to about 5 GHz), and the third radiation pattern 116 may have a resonance frequency corresponding to a 4 G communication (e.g., from about 1.7 GHz to 2 GHz).

The resonance frequency of each radiation patterns 110 may be properly changed or added according to a use and a structure of an electronic device to which the film antenna is employed. For example, a radiation pattern for a near field communication (NFC) may be disposed at an outside of the third radiation pattern 116.

The radiation patterns 110 may be electrically connected to a driving circuit unit (DC) via the transmission lines 120. In exemplary embodiments, a plurality of radiation patterns 110 as described above may be integrated by one driving circuit unit DC through the transmission lines 120. The driving circuit unit DC may include, e.g., an integrated circuit (IC) chip.

The first radiation pattern 112, the second radiation pattern 114 and the third radiation pattern 116 may be connected to the driving circuit unit (DC) via the first transmission line 122, the second transmission line 124 and the third transmission line 126, respectively.

The driving circuit unit DC may drive each radiation pattern 110 independently. For example, the first radiation pattern 112, the second radiation pattern 114 and the third radiation pattern 116 may each be turned on/off independently by the driving circuit unit DC.

In an embodiment, one radiation pattern of the first radiation pattern 112, the second radiation pattern 114 and the third radiation pattern 116 may be selectively driven by the driving circuit unit DC. In an embodiment, two or more radiation patterns among the first radiation pattern 112, the second radiation pattern 114 and the third radiation pattern 116 may be selected and driven by the driving circuit unit DC.

In exemplary embodiments, the radiation patterns 110 may be disposed at the same layer or at the same level on an upper surface of the dielectric layer 100. The transmission lines 120 may also be disposed at the same level with the radiation patterns 110. Accordingly, the radiation patterns corresponding to a plurality of resonance frequencies may be accommodated in a limited space of a single film using the above-described loop shape. Therefore, selective or simultaneous transmission and reception of the plurality of resonant frequencies may be implemented by the film antenna.

Further, a width or a length of each radiation pattern 110 may be adjusted according to an operable frequency in consideration of the dielectric constant of the dielectric layer 100.

The radiation pattern 110 and/or the transmission line 120 may include silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), zinc (Zn), molybdenum (Mo), calcium (Ca) or an alloys. These may be used alone or in combination thereof. For example, the radiation pattern 110 and/or the transmission line 120 may be formed of silver (Ag) or a silver alloy (e.g., silver-palladium-copper (APC) alloy), or copper or a copper alloy (e.g., a copper-calcium (CuCa) alloy) for implementing a low resistance and a fine line width.

In some embodiments, the radiation pattern 110 and/or the transmission line 120 may include a transparent metal oxide such as indium tin oxide (ITO), indium zinc oxide (IZO), indium zinc tin oxide (ITZO), zinc oxide (ZnOx), etc.

In some embodiments, the radiation pattern 110 and/or transmission line 120 may have a multi-layered structure including a metal layer and a transparent metal oxide layer. In some embodiments, the radiation pattern 110 and/or transmission line 120 may include a mesh-pattern structure to have improved transmittance.

In some embodiments, the radiation pattern 110 may have a high transmittance metal thin film structure. For example, the radiation pattern 110 may have a solid metal thin film structure of a thickness from about 50 Å to about 200 Å. For example, the transmittance of the radiation pattern 110 may be about 70% or more, preferably about 80% or more.

In some embodiments, a ground layer 90 may be formed on a lower surface of the dielectric layer 100. For example, a capacitance or inductance may be formed between the electrode layer 115 and the ground layer 90 by the dielectric layer 100, so that a frequency band driven or sensed by the film antenna may be controlled. For example, the film antenna may be provided as a vertical radiation antenna.

The ground layer 90 may include a metal, an alloy or a transparent conductive oxide. In an embodiment, a conductive member (a TFT electrode, a pixel electrode, a common electrode, etc.) of a display device in which the film antenna is employed may serve as the ground layer 90.

Figure 3:
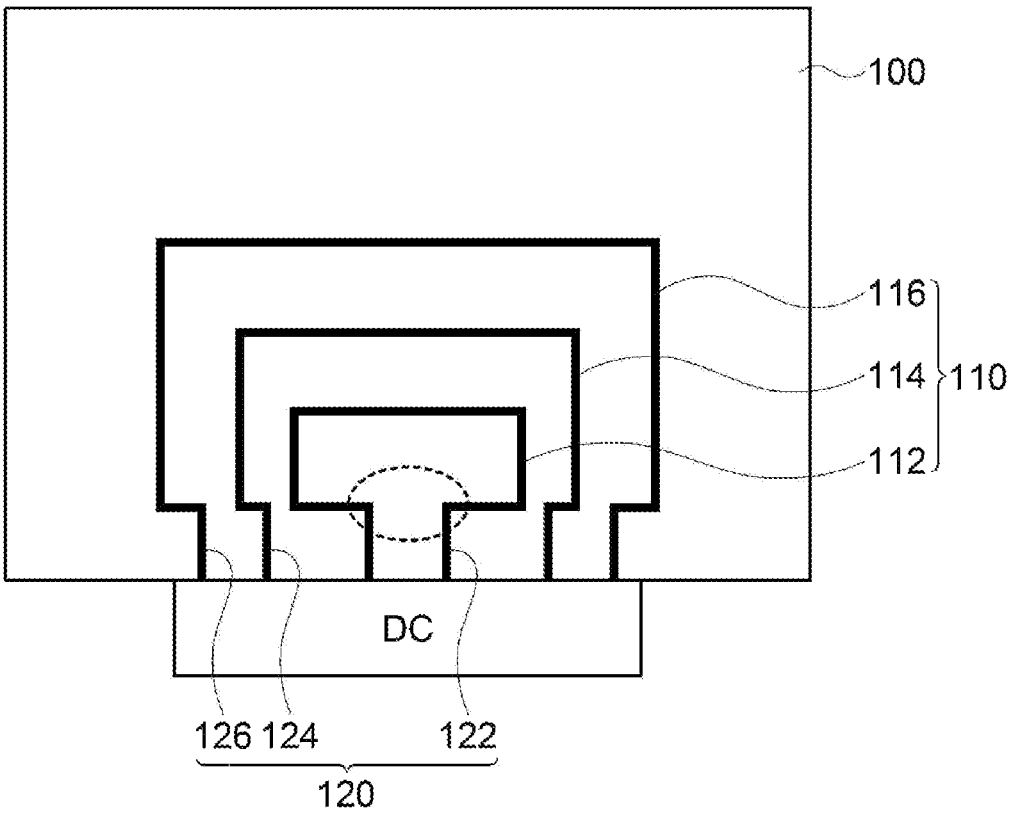
FIG. 3 is a schematic top planar view illustrating a film antenna in accordance with some exemplary embodiments.

FIG. 3 is a schematic top planar view illustrating a film antenna in accordance with some exemplary embodiments.

Referring to FIG. 3, each radiation pattern 110 may form a loop together with the transmission line 120. In this case, each radiation pattern 110 may include an open area as indicated by a dotted circle in FIG. 3, and may be connected to the transmission line 120 by the open area.

Figure 4:
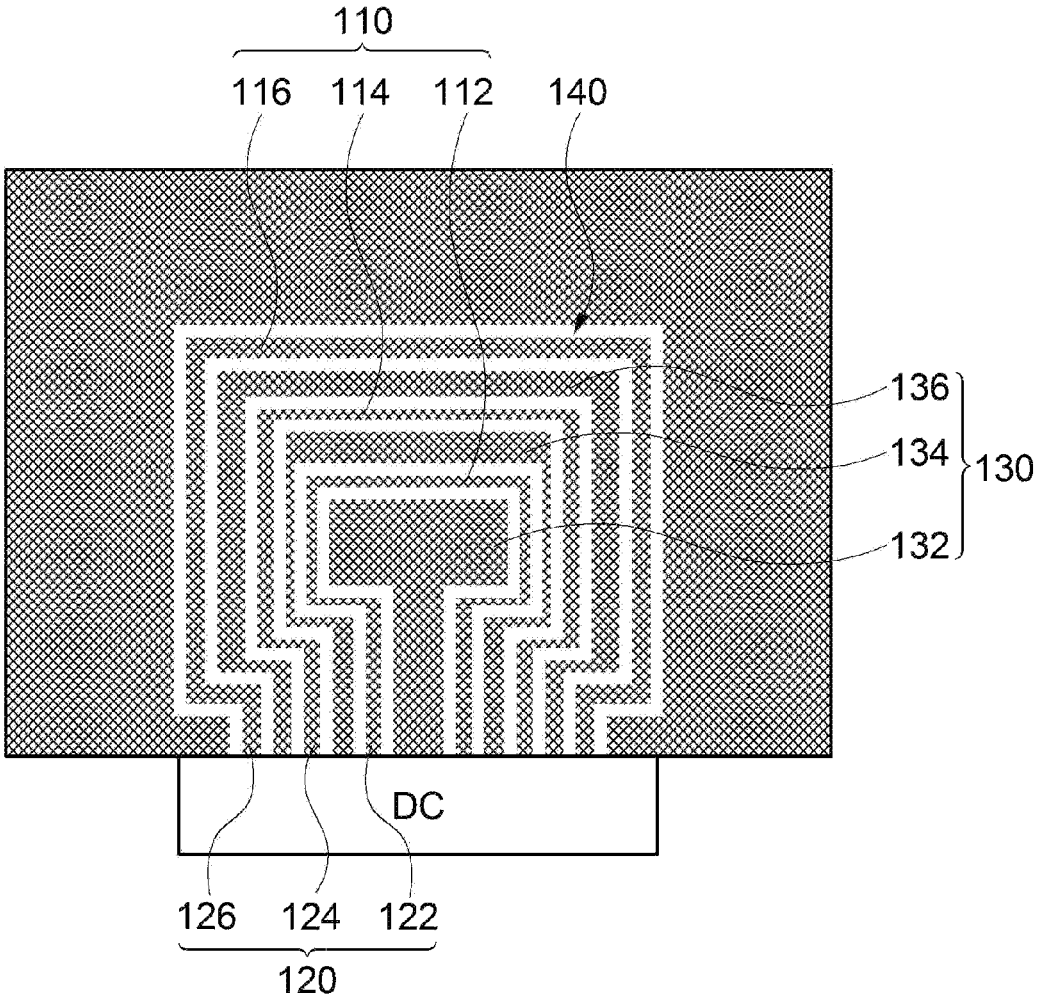
FIG. 4 is a schematic top planar view illustrating a film antenna in accordance with some exemplary embodiments.

FIG. 4 is a schematic top planar view illustrating a film antenna in accordance with some exemplary embodiments.

Referring to FIG. 4, a space at an inside of each radiation pattern radiation pattern 110 or a space between the radiation patterns 110 may be defined as a dummy region. For example, a first dummy region may be defined at an inside the first radiation pattern 112, a second dummy region may be defined between the second radiation pattern 114 and the first radiation pattern 112, and a third dummy region may be defined between the third radiation pattern 116 and the second radiation pattern 114.

In exemplary embodiments, a dummy mesh pattern 130 may be formed in each dummy region. A first dummy mesh pattern 132 may be formed in the first dummy region, a second dummy mesh pattern 134 may be formed in the second dummy region, and a third dummy mesh pattern 136 may be formed in the third dummy region.

In some embodiments, the radiation patterns 110 may also include a mesh pattern structure. Thus, a transmittance of the film antenna may be improved. Additionally, a visual recognition of electrodes according to a pattern shape deviation may be reduced by the formation of the dummy mesh pattern 130.

A separation region 140 may be formed along a profile of each radiation pattern 110. The radiation pattern 110 and the dummy mesh pattern 130 may be separated or insulated by the separation region 140.

In some embodiments, a dummy mesh pattern may also be formed in an outer region of the third radiation pattern 116. For example, a mesh pattern layer may be formed substantially on an entire upper surface of the dielectric layer 100. The mesh pattern layer may be divided by the separation region 140 such that the radiation pattern 110 and the dummy mesh pattern 130 may be defined.

In some embodiments, the transmission lines 120 may also include the mesh pattern structure, and may be integrally formed with the radiation pattern 110.

Figure 5:
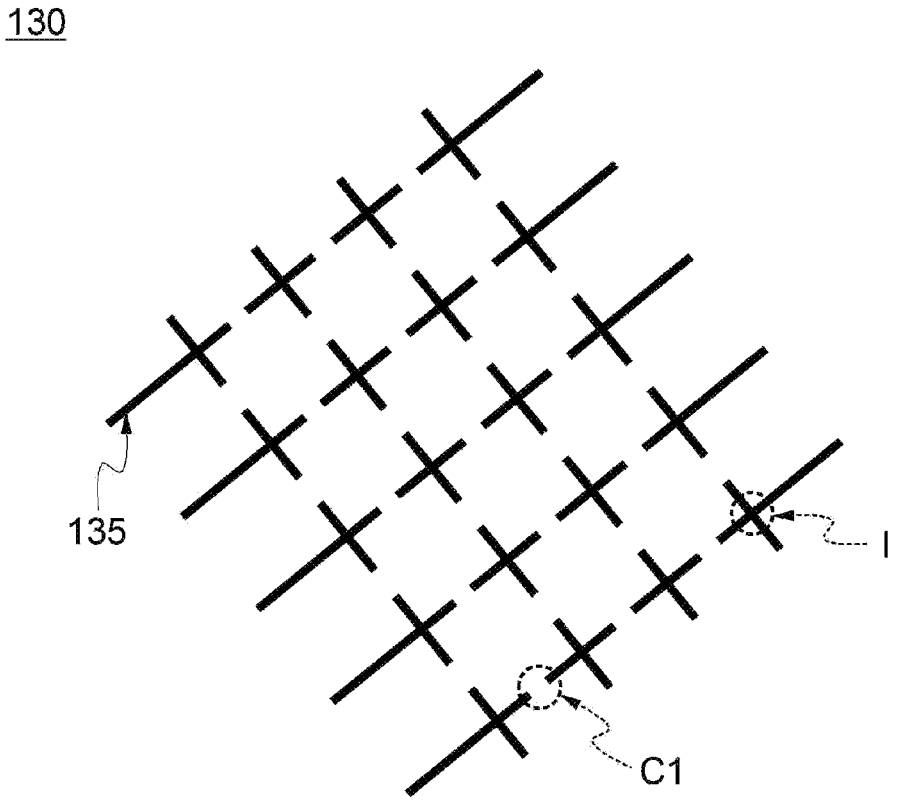
FIGS. 5 and 6 are partially enlarged views illustrating a construction of a dummy mesh pattern in the film antenna.
Figure 6:
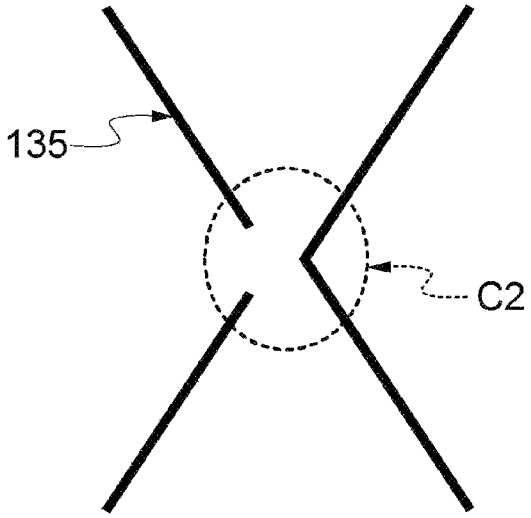

FIGS. 5 and 6 are partially enlarged views illustrating a construction of a dummy mesh pattern in the film antenna.

Referring to FIG. 5, the dummy mesh pattern 130 may include, e.g., a plurality of mesh unit cells defined by electrode lines 135 crossing each other. The mesh unit cell may have a rhombus shape as illustrated in FIG. 5.

In some embodiments, the mesh unit cell may include a cut region C1. For example, the cut region C1 may be formed at each side of the mesh unit cell.

The dummy mesh pattern 130 may include cut regions C1 so that the dummy mesh pattern 130 may be substantially provided as an insulator. Accordingly, optical properties of the film antenna may be improved while suppressing signal interference to the adjacent radiation pattern 110.

Positions of the cut regions may be properly adjusted from an example of FIG. 5.

Referring to FIG. 6, in some embodiments, a cut region C2 may be formed at an intersecting region (designated as "I" in FIG. 5) of the electrode lines 135 included in the dummy mesh pattern 130.

For example, as illustrated in FIG. 6, at least a portion of the electrode lines at the intersecting region I may be cut such that the cut region C2 may be defined.

Figure 7:
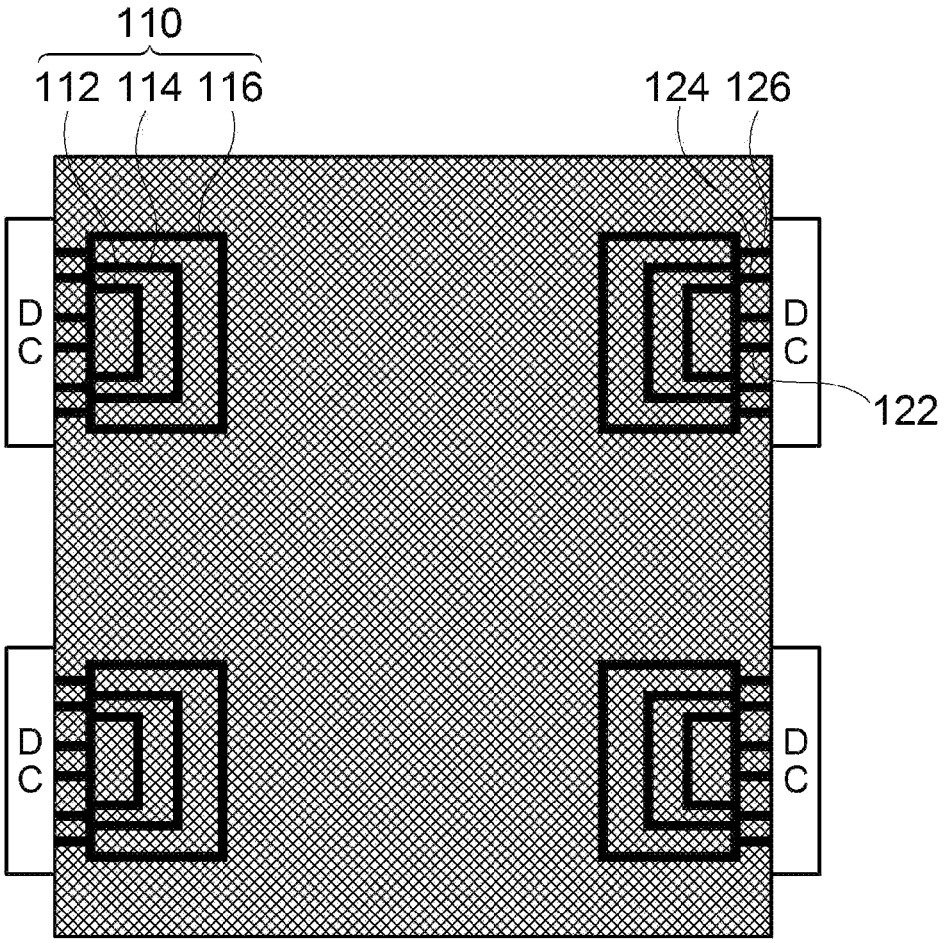
FIG. 7 is a schematic top planar view illustrating a film antenna applied to a display device in accordance with exemplary embodiments.

FIG. 7 is a schematic top planar view illustrating a film antenna applied to a display device in accordance with exemplary embodiments.

Referring to FIG. 7, the film antenna may include a plurality of driving circuit units DC. For example, the driving circuit units DC may be distributed at both lateral portions of the film antenna.

As described above, the radiation patterns 110 having different frequencies may be integrated via the transmission line 120 by each driving circuit unit DC.

Further, the driving circuits DC may be uniformly distributed along a peripheral area of the film antenna so that signal sensitivity may be improved, and signal loss or signal blocking may be prevented.

As described above, a region on the dielectric layer 100 except for the radiation patterns 110 and the transmission lines 120 may be substantially filled with the dummy mesh pattern.

Figure 8:
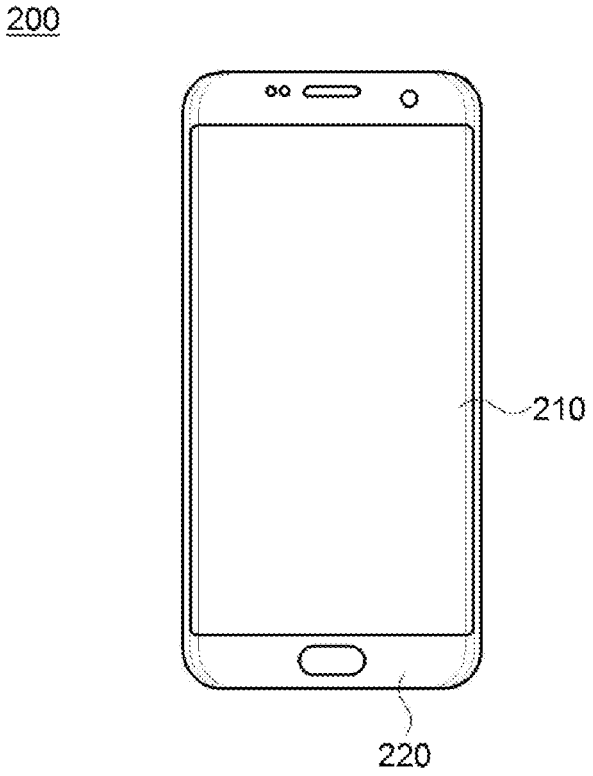
FIG. 8 is a schematic top planar view illustrating a display device in accordance with exemplary embodiments.

FIG. 8 is a schematic top planar view illustrating a display device in accordance with exemplary embodiments. For example, FIG. 8 illustrates an outer shape including a window of a display device.

Referring to FIG. 8, a display device 200 may include a display region 210 and a peripheral region 220. The peripheral region 220 may be positioned, e.g., at both lateral portions and/or both end portions.

In some embodiments, the above-described film antenna may be disposed at a front face of the display device 200. In this case, the radiation patterns 110 and dummy mesh patterns 130 of the film antenna may be disposed on the display region 210 of the display device 200. As described above, transmittance may be improved by using a mesh pattern, and visual recognition of electrodes visibility may be suppressed.

The driving circuit unit DC of the film antenna may be disposed to correspond to the peripheral region 220 of the display device 200. The peripheral region 220 may correspond to, e.g., a light-shielding portion or a bezel portion of the display device.

In exemplary embodiments, high-frequency and low-frequency bands may be implemented through a plurality of the driving circuit units DC and the radiation patterns 110 of different resonance frequencies, and a communication function with improved signal sensitivity may be implemented in the display device 200.

What is claimed is:

1. A film antenna, comprising:

a plurality of radiation patterns corresponding to different frequency bands;

transmission lines extending from each of the radiation patterns; and a driving circuit unit connected to the transmission lines, wherein the plurality of radiation patterns are electrically and physically separated from each other, and each of the plurality of radiation patterns has a single loop shape so that one radiation pattern of the plurality of radiation patterns is disposed in a space within another radiation pattern of the plurality of radiation patterns, and each of the plurality of radiation patterns is independently driven by the driving circuit unit, and the film antenna is operable in a frequency band from 20 GHz to 60 GHz.

2. The film antenna according to claim 1, wherein the plurality of radiation patterns comprise a first radiation pattern, a second radiation pattern and a third radiation pattern arranged sequentially from the driving circuit unit.

3. The film antenna according to claim 2, wherein resonance frequencies sequentially decrease in an order of the first radiation pattern, the second radiation pattern and the third radiation pattern.

4. The film antenna according to claim 2, wherein the first radiation pattern, the second radiation pattern and the third radiation pattern are each independently controlled by the driving circuit unit.

5. The film antenna according to claim 2, wherein the first radiation pattern, the second radiation pattern and the third radiation pattern each has the single loop shape; and the first radiation pattern is disposed in a space within the single loop shape of the second radiation pattern, and the second radiation pattern is disposed in a space within the single loop shape of the third radiation pattern.

6. The film antenna according to claim 5, further comprising a dummy mesh pattern between the plurality of radiation patterns or in a space within the loop shapes of the plurality of radiation patterns.

7. The film antenna according to claim 6, wherein the dummy mesh pattern includes cut regions.

8. The film antenna according to claim 1, wherein the plurality of radiation patterns include a mesh pattern structure.

9. The film antenna according to claim 1, wherein the driving circuit unit comprises a plurality of driving circuit units, and the plurality of radiation patterns of different frequency bands are integrated with each of the driving circuit units.

10. The film antenna according to claim 1, wherein the plurality of radiation patterns are positioned on the same plane.

11. The film antenna according to claim 10, further comprising:

a dielectric layer on which the plurality of radiation patterns are disposed; and a ground layer disposed under the dielectric layer.

12. A display device comprising the film antenna according to claim 1.

13. The display device according to claim 12, wherein the film antenna is disposed at a front face of the display device.

14. The display device according to claim 13, wherein the plurality of radiation patterns are disposed on a display region of the display device.

* * * * *